US005848537A

United States Patent [19]

Biancardi et al.

[11] Patent Number: 5,848,537

[45] Date of Patent: Dec. 15, 1998

[54] VARIABLE REFRIGERANT, INTRASTAGE COMPRESSION HEAT PUMP

[75] Inventors: Frank R. Biancardi, South Windsor; David J. McFarlin, Ellington; Raymond L. DeBlois, Tolland; Tobias H. Sienel, Manchester, all of Conn.

[73] Assignee: Carrier Corporation, Farmington, Conn.

[21] Appl. No.: 916,484

[22] Filed: Aug. 22, 1997

[51] Int. Cl.[6] ..... F25B 13/00

[52] U.S. Cl. ..... 62/324.6

[58] Field of Search ..... 62/324.1, 324.6, 62/503, 114, 324.4

[56] References Cited

U.S. PATENT DOCUMENTS

| | | | |
|---|---|---|---|
| 4,551,983 | 11/1985 | Atsumi et al. | 62/174 |
| 4,620,423 | 11/1986 | Hopkinson et al. | 62/77 |
| 4,913,714 | 4/1990 | Ogura et al. | 62/149 |
| 5,551,255 | 9/1996 | Rothfleisch | 62/502 |
| 5,655,379 | 8/1997 | Jaster et al. | 62/210 |

FOREIGN PATENT DOCUMENTS

| | | | |
|---|---|---|---|
| 15549 | 2/1979 | Japan | 62/324.6 |
| 140247 | 10/1979 | Japan | 62/324.6 |
| 405215427 | 8/1993 | Japan | 62/324.6 |

*Primary Examiner*—William Doerrler

[57] ABSTRACT

A heat pump system, utilizing a multi-component refrigerant blend in which a low pressure component is zeotropic with respect to the remainder of the blend, separates the low pressure component by rectification to enhance heating capability in low ambient temperatures. Vapor is separated from liquid in the effluent of the condenser of a heat pump, at a pressure in equilibrium at a temperature midway between the evaporator and condenser effluent temperatures, the vapor being applied to an auxiliary inlet at a mid pressure point in the compression stroke of the compressor.

3 Claims, 13 Drawing Sheets

VARIABLE REFRIGERANT, INTRASTAGE COMPRESSION HEAT PUMP

TECHNICAL FIELD

This invention relates to heat pumps utilizing variable refrigerant composition to provide improved efficiency over extended ranges and/or vapor injection into the compressor to provide increased capacity and efficiency, in both heating and cooling modes.

BACKGROUND ART

Heat pump systems are usually bidirectional, that is, they can provide heating or cooling, or sometimes both simultaneously. It has been known to utilize multiple component CFC or HCFC refrigerants to extend the low temperature end of the useful range for heat pumps when used for heating. However, recent restrictions on the use of CFC's or HCFC's due to the chlorine content that can contribute to the depletion of the earth's ozone layer and global warming, emphasis has now shifted to the use of HFC's and other environmentally acceptable refrigerants. Current electrically-powered residential and small commercial heat pump systems have two operating and performance constraints. Mainly, they have insufficient capacity at low ambient temperatures, below about 30° F. or 40° F., so that supplemental heat sources such as electric resistance heating or fossil fuel fires must be utilized. Additionally, the temperature to which air can be heated by a heat pump working in low ambient temperatures are low for human comfort; air below about 90° F. entering a room provides a draft chill discomfort due to the flow of the air.

DISCLOSURE OF THE INVENTION

Objects of the invention include provision of a heat pump system that has a very wide ambient temperature operating range, which operates efficiently within this wide ambient temperature range, which matches building heating load requirements, which provides comfortable room air delivery temperatures by efficiently providing space heating air at a sufficiently high temperature so as not to create a draft chill effect, and which utilizes environmentally acceptable, safe refrigerants. Other objects include increasing the capacity and efficiency of a heat pump system having a given compressor.

According to a first aspect of the present invention, a heat pump system employing a multi-component, zeotropic blended refrigerant having one or more components which have higher boiling points than other components of the blend, utilizes a quantity of the refrigerant sufficient to fulfill system capacity with a substantial portion of the lower pressure component(s) separated from the blend, and a storage tank fed by a rectification column and separator to remove low pressure component(s) from the system blend. According further to this aspect of the invention, fluid in the storage tank may be heated to further increase the low pressure component(s) separated from the blend. In accordance further with this aspect of the invention, the storage tank fluid may be heated by the outflow of the condenser, when the system is operating in the heating mode, thereby sub-cooling the return refrigerant. When the low pressure component has been substantially removed from the blend in the system, and is residing in the storage tank, it may be isolated, and there is no need to continue the rectification process or any special heating or cooling of refrigerant. Or, the rectification process may continue during the entire period of operation in the heating mode. This aspect of the present invention works perfectly well with numerous HFC blends and other environmentally acceptable refrigerants. One such refrigerant lend, R407C works especially well because of the content of R32, R125 and R134a. The current composition consists of R32 (23%), R125 (25%) and R134a (the low pressure component) is 52%. However, various combinations of these refrigerants and other HFC's will also work efficiently.

In accordance with another, intrastage compression aspect of the present invention, refrigerant vapor is separated from the system refrigerant flow at a selected pressure in equilibrium with a temperature between a temperature of effluent of the condenser and that of the evaporator, the vapor then enters into the compressor at substantially said selected pressure point in the compression stroke thereof. In accordance with this aspect of the invention, vapor separation may be achieved by providing heat exchange between liquid and vapor components of the refrigerant flow. This aspect of the present invention provides significantly increased efficiency and capacity in a heat pump system for any given compressor.

According to the invention, adjustment of the refrigerant blend to extend the range of effective and efficient heating and provide improved room-entry air delivery temperature, as well as separating vapor at a selected intermediate pressure and applying it to an inlet at a like pressure point in the stroke of the compressor may be utilized together so as to greatly improve the capacity, the efficiency, and the temperature range of effective usefulness of a heat pump system.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
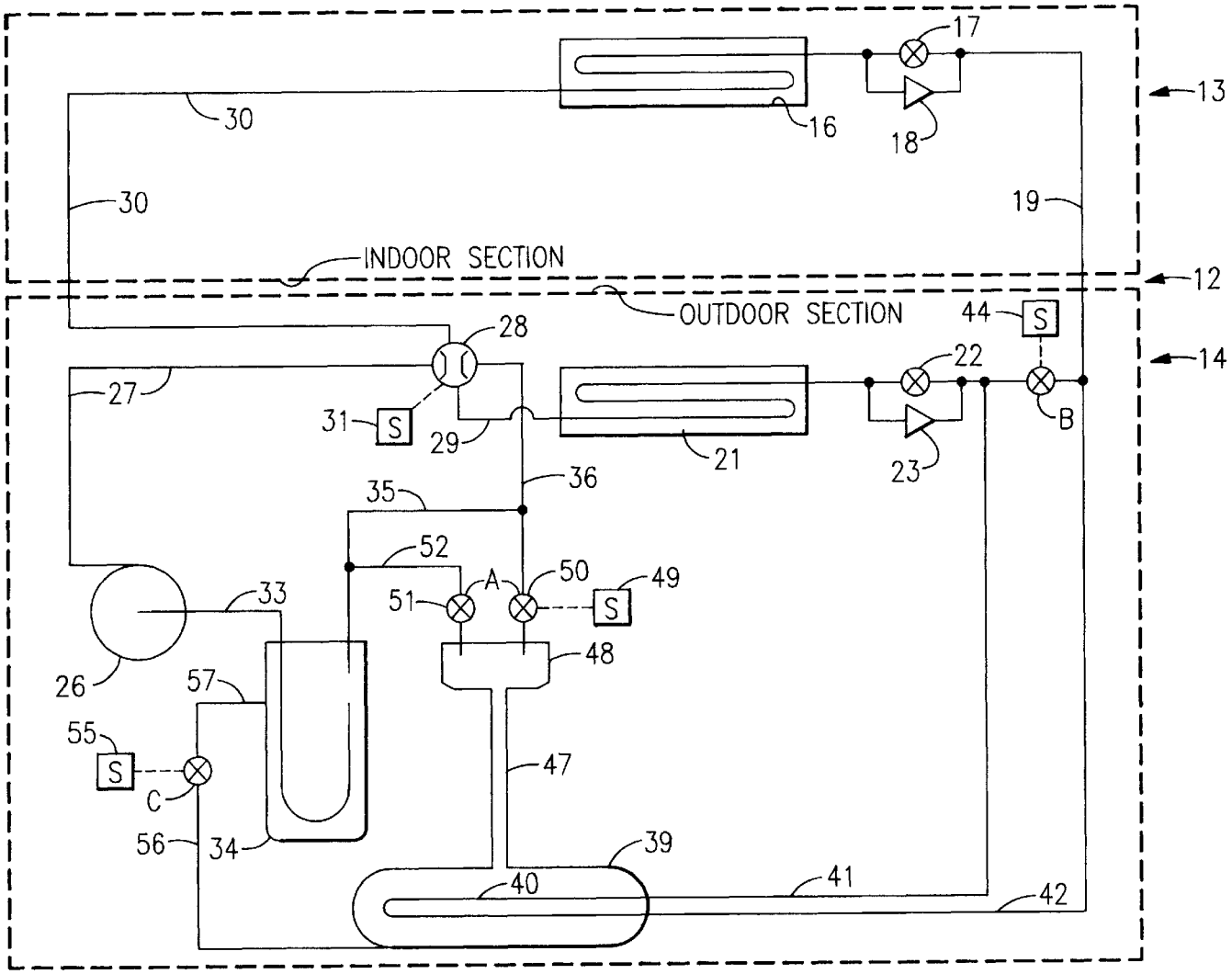
FIG. 1 is a schematic diagram of a bidirectional heat pump system in accordance with a first aspect of the present invention, showing all of the valves, connecting lines and components in the system before the operating modes and embodiments are selected.

Referring now to FIG. 1, a heat pump system 12 in accordance with the present invention includes an indoor section 13 and an outdoor section 14. The indoor section includes a conventional primary coil 16, an expansion valve 17, and a unidirectional flow device such as a check valve 18. The check valve 18 renders the expansion valve 17 inoperative except when the flow is anticlockwise in the indoor section.

The outdoor section 14 includes a conventional primary coil 21, an expansion valve 22, and a unilateral flow device such as a check valve 23. The outdoor section also includes a compressor 26 which is connected by a conduit 27 to a four-way valve 28, which is shown in FIG. 1 in a neutral position. The valve 28 is positionable, electrically or electronically, such as by a solenoid 31, so as to connect the conduit 27 through a conduit 29 to the coil 21 when the heat pump system is in a cooling mode, or (in another position) to connect the conduit 27 through a conduit 30 to the coil 16 during heating mode of operation. These modes are described more fully with respect to FIGS. 2–7, hereinafter. For purposes of the first aspect of the present invention, the compressor 26 may be any conventional piston or scroll or other type of compressor. In order to incorporate intrastage compression aspects of the present invention, as described with respect to FIGS. 8–10 hereinafter, a modified scroll compressor is preferred; however, other compression types such as a screw, rotary or reciprocating compressors may be used, if desired, to provide the intrastage compression technique.

The compressor 26 is fed by a conduit 33 from a conventional suction accumulator 34, the input to which in conduits 35, 36 may be from either coil 16 or coil 21 depending upon the position of the four-way valve 28. The accumulator 34 will have a conventional oil bleed (not shown) for slowly metering all of the liquid in the accumulator back to the compressor so as to recover compressor oil.

The apparatus described thus far is conventional. Details of low pressure refrigerant storage according to the invention are summarized with respect to FIG. 1 and explained more fully with respect to FIGS. 2–7. In accordance with the invention, a low pressure refrigerant storage tank 39 includes a heating coil 40 which is connected by conduits 41, 42 to opposite sides of a valve B which is selectively operable by any suitable electrical or electronic means, such as a solenoid 44. With the valve B open, the conduits 41, 42 and the heating coil 40 are essentially not in the system. The storage tank 39 is fed by a conventional rectification column 47 which works in conjunction with a conventional liquid/vapor separator 48 in a manner such that when a pair of valves A are closed, the tank 39, column 47 and separator 48 are essentially out of the system. When the valves A are both opened, by any suitable electrical or electronic means such as a solenoid 49, the highly vaporized returning refrigerant in conduit 36 is fed through the right hand valve A 50 into the separator 48. The liquid tends to flow downwardly through the column 47. The vapor of the less volatile (lower pressure) refrigerant of a zeotropic refrigerant blend tends to condense on packing within the column 47, in a conventional manner. Vapor of the more volatile (higher pressure) components of the mixture will tend to separate from the liquid and will pass through the left-hand one of the valves A 51 through a conduit 52 into the conduit 35 for return to the suction accumulator 34. In accordance with the invention, with the valves A open, the system is charged with sufficient refrigerant so that the system capacity can be fulfilled with the higher pressure components when the low pressure components are separated out, which for R407C will be twice (or more) of the charge required at the highest ambient temperature for which the system is rated. When the valves A are open and the valve B is closed, the return refrigerant will flow through the conduits 41 and 42 through the heating coil 40 tending to heat the liquid in the tank 39, causing the more volatile components to vaporize and flow upwardly through the column 47. Some of the upwardly flowing vapor of the less volatile component will condense as it cools during its upward flow, and return to the tank 39. The heat from the coil 40 tends to increase the separation of low pressure refrigerant from higher pressure refrigerant in the column 47. Instead of the separator 48, a flow distributor may be utilized; but a simple separator configuration is very cost effective and suitable.

According further to the invention, derectification can be achieved by means of a valve C, which can be selectively opened or closed by any suitable electrical or electronic means such as a solenoid 55 to connect the bottom of the storage tank 39 through conduits 56, 57 to the vacuum accumulator 34. In one embodiment, the storage tank 39 can be mounted vertically higher than the inlet to the accumulator 34 so that liquid can flow from the tank 39 to the accumulator 34 through the force of gravity. In another embodiment, when derectification is desired, the valves A, B and C can be closed, heating the fluids in the tank 39, the column 47 and the separator 48 until there is a sufficient pressure buildup so that opening of the valve C will force the liquid out of the tank 39 through the conduits 56, 57 and into the vacuum accumulator 34. During either rectification or derectification, an electric immersion heater may be used in place of the coil 40, the conduits 41 and 42 and the valve B if desired. However, the apparatus shown including the coil 40 is more economical since it will avoid the use of electrical energy and will subcool the returning refrigerant.

Although the particular refrigerant composition is not relevant to the present invention, an exemplary, commercially available refrigerant is R407C in which the mass percentage of R32 is 23%, of R125 is 25%, and of R134a is 52%. Several other HFC refrigerant zeotropic blends can be utilized depending upon the desired range of heating and cooling change desirable.

In accordance with the invention, when the heat pump system of FIG. 1 is to be utilized for heating the indoor section 13, efficiency can be improved, the outdoor temperature from which heat can be extracted can be significantly lower, and the indoor temperature actually entering the room can be raised significantly, so as to avoid draft-chilling effects, by altering the refrigerant composition to a more volatile mix by effectively removing a significant portion of the lowest pressure (least volatile) component in the refrigerant blend. As is known, R407C is zeotropic with respect to its R134a component and the other components. Thus, the R134a component can be separated from the R32 and R125 components by selective vaporization and condensation, in a known fashion. The present invention accomplishes this in an improved fashion which does not require steady state heating or cooling of the refrigerant to maintain the rectification process during heating operation, and which achieves compositions yielding much greater efficiencies than those heretofore attainable. However, the invention may be used with rectification continuing throughout the heating season since the use of return refrigerant to heat the fluid in the storage tank subcools the refrigerant, increasing efficiency.

Figure 2:
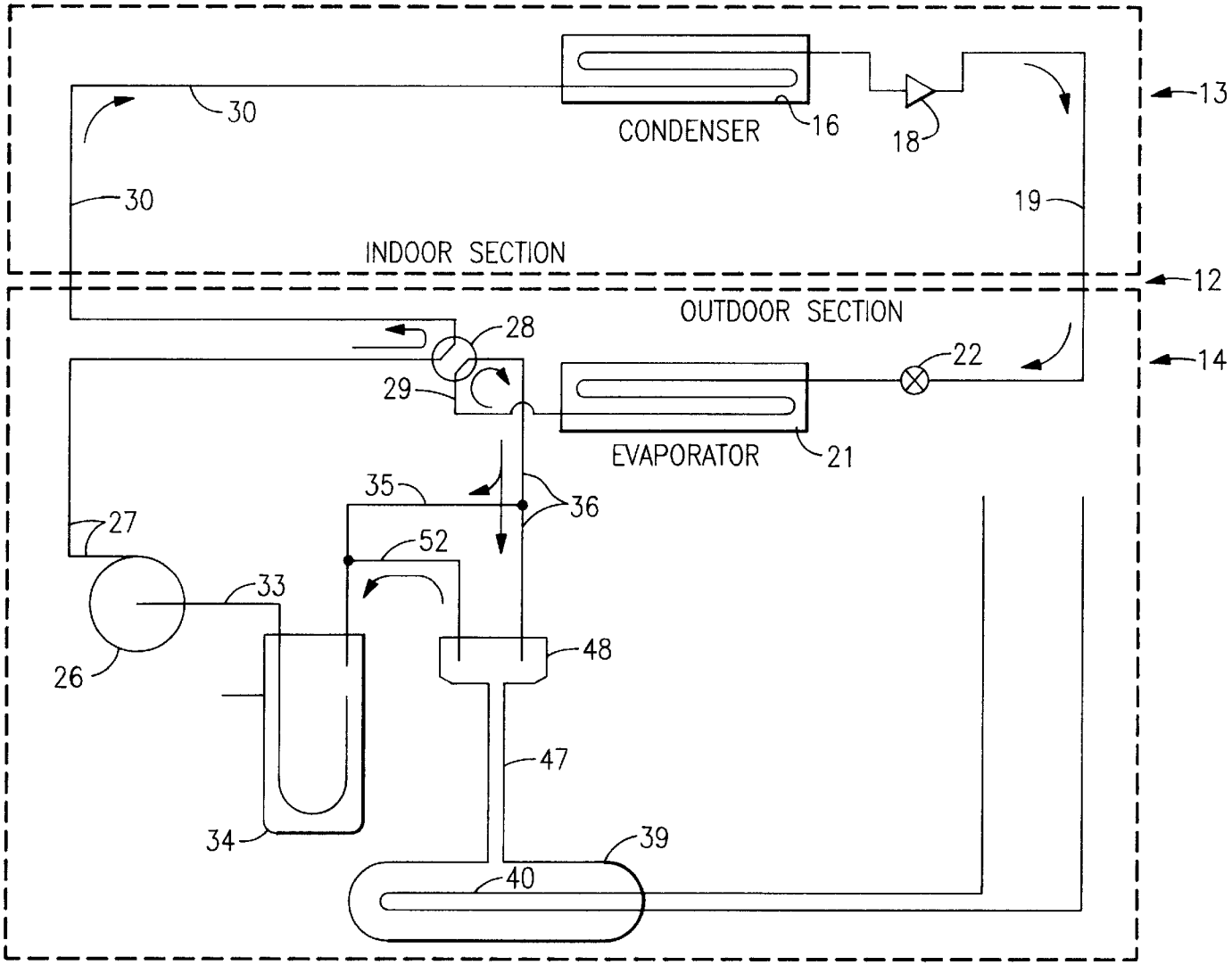
FIG. 2 is a schematic diagram of the system of FIG. 1, showing effective operation of only those parts which are used during charging of the system with excess refrigerant.
Figure 3:
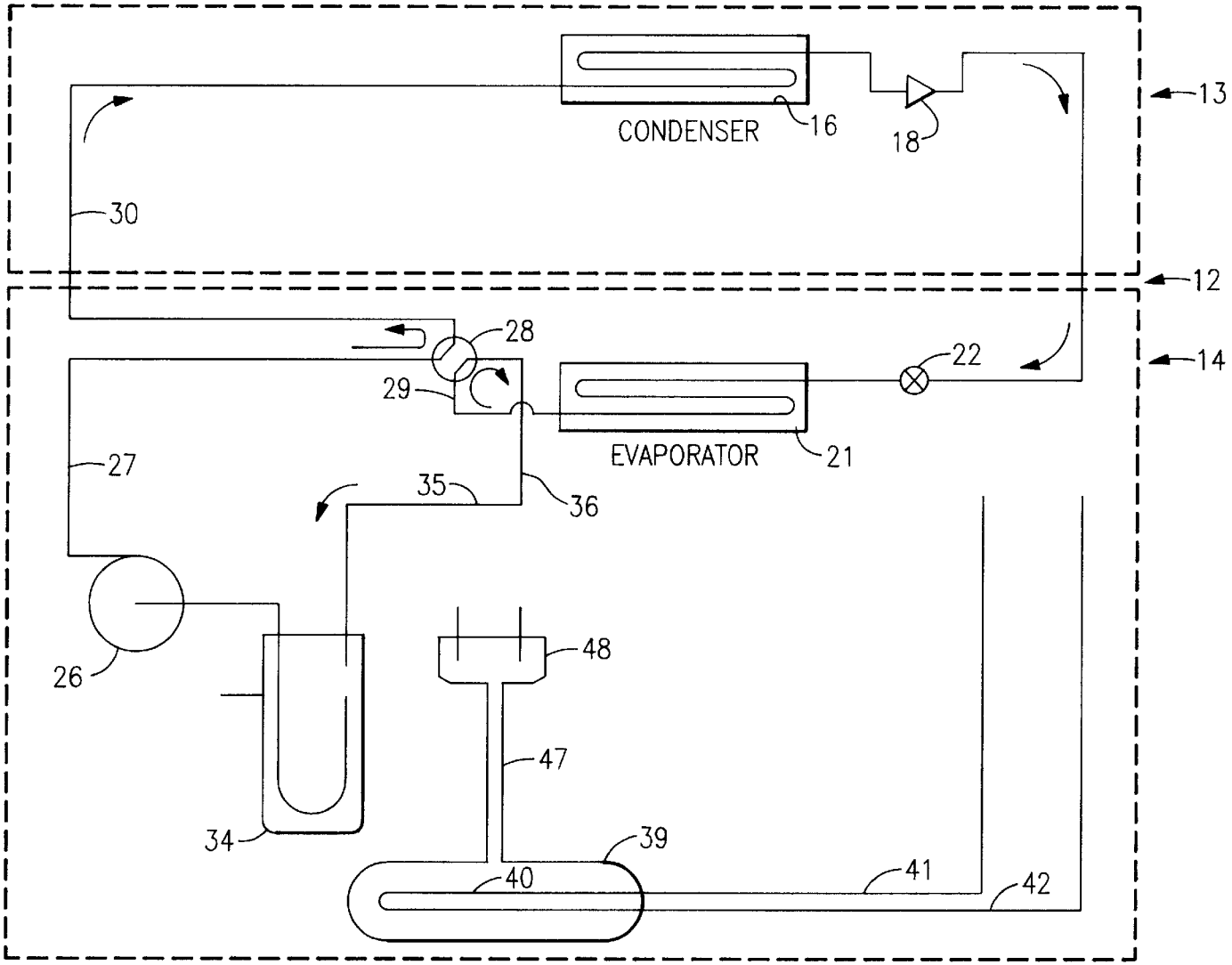
FIG. 3 is a schematic diagram of the system of FIG. 1 showing effective operation of only the components used in a steady state heating mode, following operation in accordance with FIG. 2.

One aspect of the invention is that the system be overcharged with refrigerant, by up to twice its capacity or even more. In order to do this, the excess refrigerant is stored in the tank 39. In FIG. 2, the configuration is shown as the system may be initially charged, while operating in a heating mode. The four-way valve 28 is positioned to direct the outflow of the compressor 26 through the conduit 30 and the coil 16, which acts as a condenser, and to receive flow from the coil 21, which now acts as an evaporator, and direct it to the conduit 36 for return to the accumulator 34, thereby to heat the indoor section. In addition, the valves A are open, causing the separator 48 to be connected to the conduits 36 and 52, so that the return of refrigerant from the evaporator 21, which may have a high liquid content when the system is first started, will provide a significant portion, particularly of liquid, to the separator 48, as well as to the accumulator 34. Additionally, the valve B is open, so that the heater coil 40 is essentially out of the system. The valve C is closed so there is no connection between the bottom of the tank 39 and the accumulator 34. In this configuration, both liquid and vapor tend to flow within the column 47, the liquid flowing down to the storage tank 39 and vapor tending to flow upwardly to the separator 48, in a conventional fashion. The more volatile components of the blend will tend to remain or enter the vapor phase, whereas the less volatile component of the blend (R134a) will tend to remain or enter the liquid phase and thereby flow downwardly to the tank 39. After some period of time when the system has reached equilibrium, the mass percentage of R134a in the system (outside of the tank 39) is reduced from 52% to approximately 40% of the blend, and the storage tank 39 will contain some amount of R32 and R125. The valves A may be closed at this point in time, trapping the liquid in the tank 39, as shown in FIG. 3. The system should not continue to operate for periods of time with the valves A open since that would cause all the compressor oil to accumulate in the tank 39. The 40% R134a blend of FIG. 3 may be useful in the spring and the fall in the northern hemisphere when moderate heating requirements can be met with outside air temperatures which are above about 40°. Note that no heating or cooling is required to maintain the 40% blend.

Figure 4:
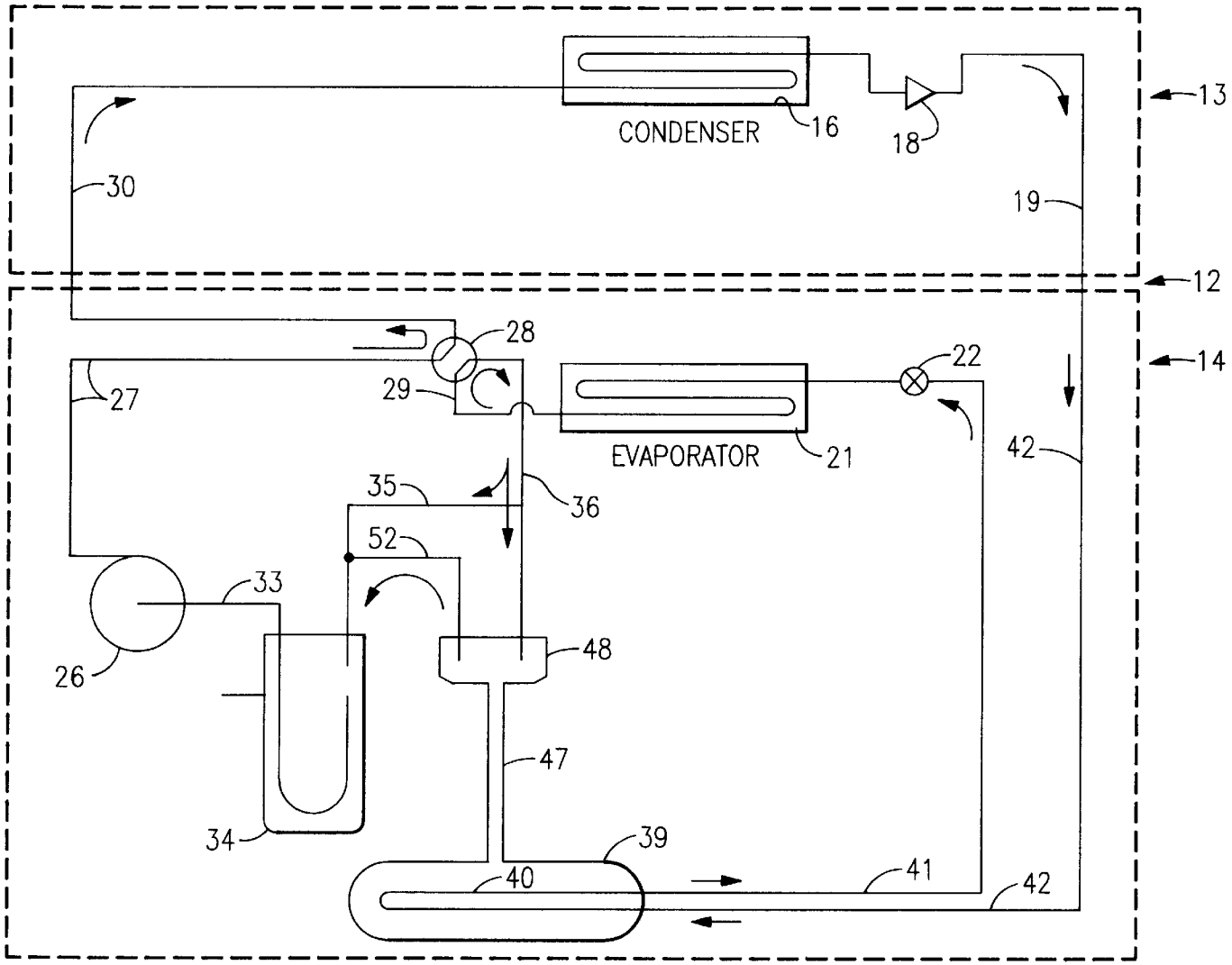
FIG. 4 is a schematic diagram of the system of FIG. 1 showing effective operation of only those parts used during rectification to convert from moderate capacity to the system's maximum heating capability.
Figure 8:
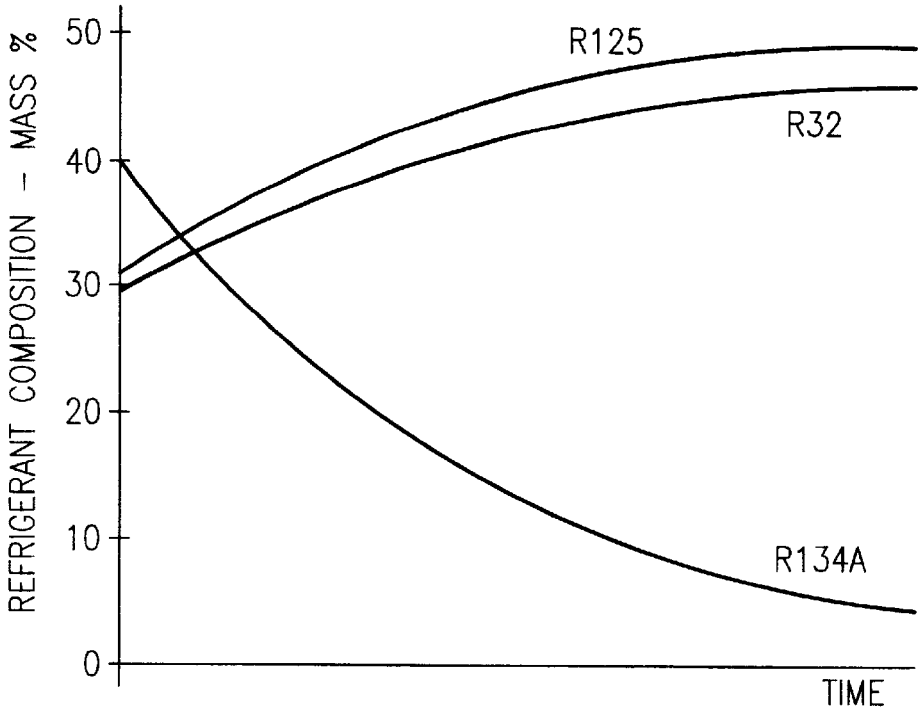
FIG. 8 is a chart of refrigerant composition (by mass) that can be experienced during the powered rectification portion typical of the cycle when heat energy is applied, illustrating that the composition of the refrigerant blend that remains in the system is changed from a high mass concentration of R134a (near 40%) after natural rectification to less than 10% after powered rectification, in accordance with a first aspect of the present invention.

The invention accommodates more vigorous heating requirements when the outside air temperature may drop well below 40° in the manner described with respect to FIG. 4. In FIG. 4, the configuration is exactly the same as in FIG. 2 except for the fact that valve B is closed causing return refrigerant to flow from the conduit 19 directly into the conduit 42, through the immersion heater 40 and the conduit 41, and thence to the expansion valve 22. This causes the liquid in the tank 39 as well as liquid and vapor in the tank and column 47 to have an increase in temperature, thereby causing blend components to vaporize, in a degree related to their respective volatilities. Some of the R407C will vaporize and flow into the column 47; as it rises, the vapor will become cooler, and some will condense on the packing, resulting in a downward flow of R407C back into the tank 39. The more volatile components (R32 and R125) will tend to remain in the vapor phase thereby reaching the separator 48 to pass through the conduit 52 into the accumulator 34. In this fashion, a new equilibrium can be reached in which the percentage of R134a can be extremely low, depending upon all system parameters. A composition having less than 5% of R134A has been readily achieved, as is illustrated in FIG. 8. It is believed that fractional percentages can be readily achieved by adjustment of system parameters utilizing conventional methodologies for the adjustments.

When equilibrium has been reached, which may typically take on the order of one-half hour to two hours or so, depending on heat, amount of charge and other parameters, there is no need to continue the rectification process. Therefore, the valves A may be closed and the valve B opened, as shown in FIG. 3. In FIG. 3, the configuration is the same as FIG. 4 except that valves A are closed and valve B is once again open, thereby effectively removing the storage tank 39, its heater 40, and conduits 41 and 42, as well as the rectification column 47 and separator 48 from the system. Now the blend is about 5% or less of R134a in the system, since most of the R134a is stored in the tank 39. Note that no heating or cooling is required to maintain this blend.

During steady state heating, with the configuration shown in FIG. 3, frost may build up on the evaporator 21. In such a case, the four-way valve 28 may be reversed so as to cause the configuration to be the same as in FIG. 7, thereby performing a defrost operation, for on the order of a few minutes, periodically. Defrost as described is conventional.

Figure 5:
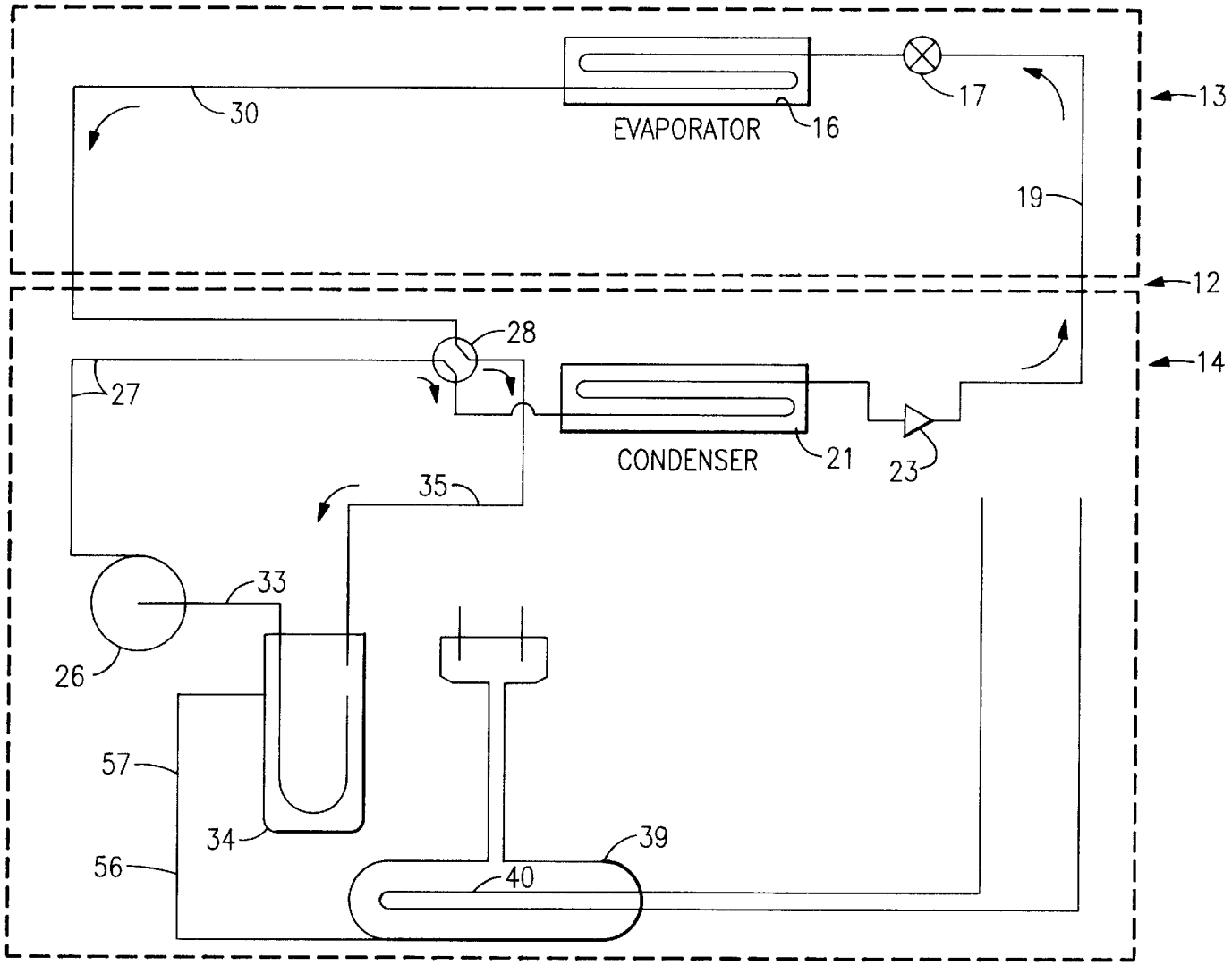
FIG. 5 is a schematic diagram of the system of FIG. 1 showing effective operation of only the components used during passive derectification to establish a cooling operation.
Figure 6:
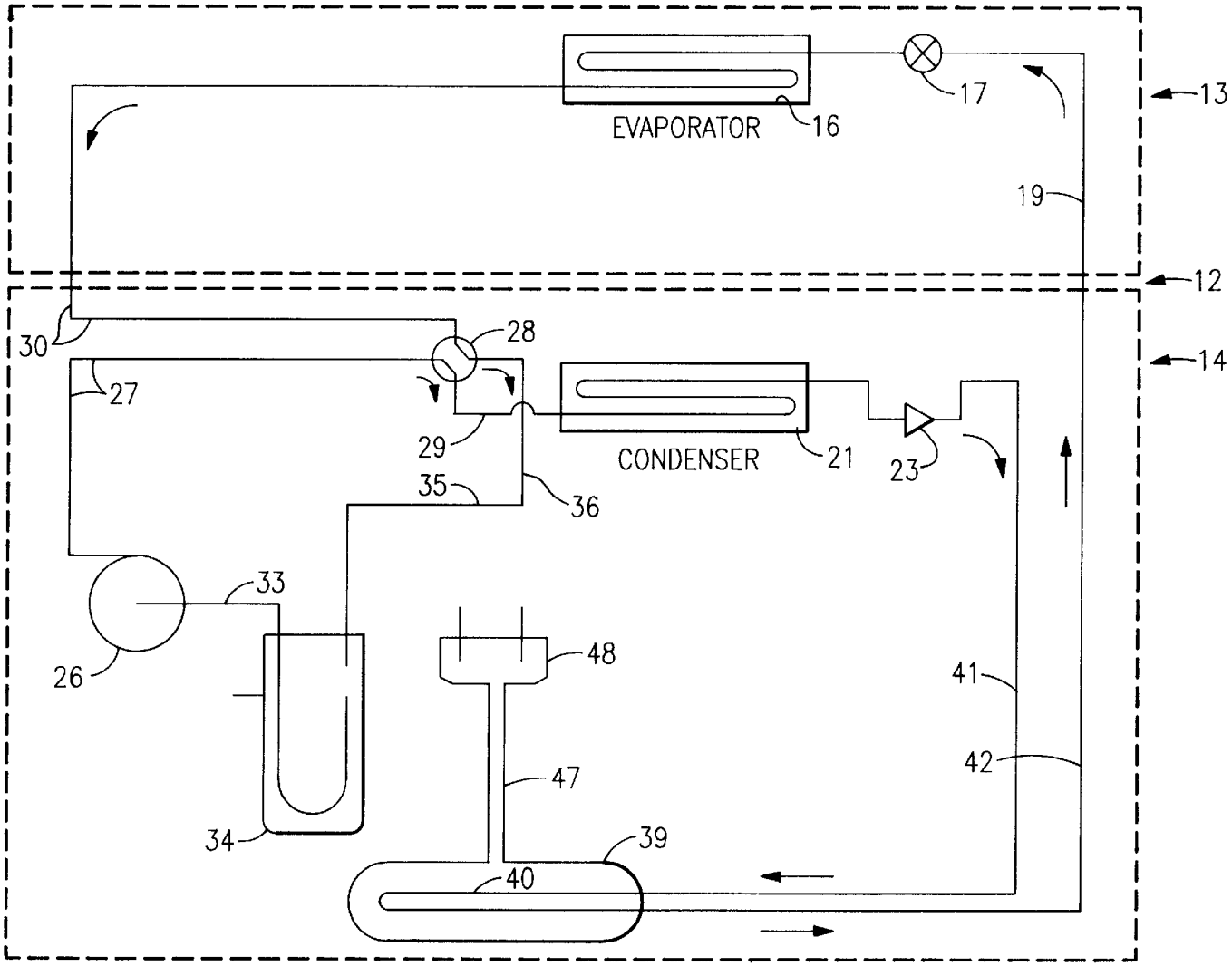
FIG. 6 is a schematic diagram of the system of FIG. 1 showing effective operation of only the components used during pressurized derectification to establish a cooling operation.

Whenever the system has too much capacity, it will run inefficiently. When heating demand has subsided (such as springtime in the northern hemisphere) and the need arises for cooling, the refrigeration blend working in the system must be restored to a blend including 40% R134a. This is achieved by derectification as illustrated in FIG. 5 and/or FIG. 6. Referring now to FIG. 5, the apparatus is depicted with the valves A and C closed and the valve B open, with the four-way valve 28 connecting the compressor 26 to the coil 21 so that flow is anticlockwise in FIG. 6; the coil 21 is acting as a condenser and the coil 16 is acting as an evaporator for cooling the indoor section. The valve C is now open, thereby connecting the bottom of the tank 39 through the conduits 56, 57 to the accumulator 34. In the simplest embodiment, the tank 39 is physically disposed vertically above the accumulator 34 and therefore the liquid in the tank 39 will simply flow into the accumulator 34. If in any embodiment of the invention the accumulator 34 cannot be positioned below the tank 39 sufficiently to assure adequate flow, pressurized derectification may be achieved as illustrated in FIG. 6. In FIG. 6, with valve B closed, the condenser outflow from the coil 21 is directed through the heater 40 of the tank 39 while the valves A and C remain closed. This will cause a pressure build up in the tank 39. After the pressure has developed sufficiently, then the apparatus can be converted to that shown in FIG. 5 by once again opening the valve B and opening the valve C while the valves A remain closed, the pressure in the tank 39 forcing the liquid out of the tank 39 through the conduits 56, 57 and into the accumulator 34. Of course, pressurizing the tank 39 can be used in conjunction with the tank 39 being of a suitable height with respect to the accumulator 34, for some gravity flow, if desired.

Figure 7:
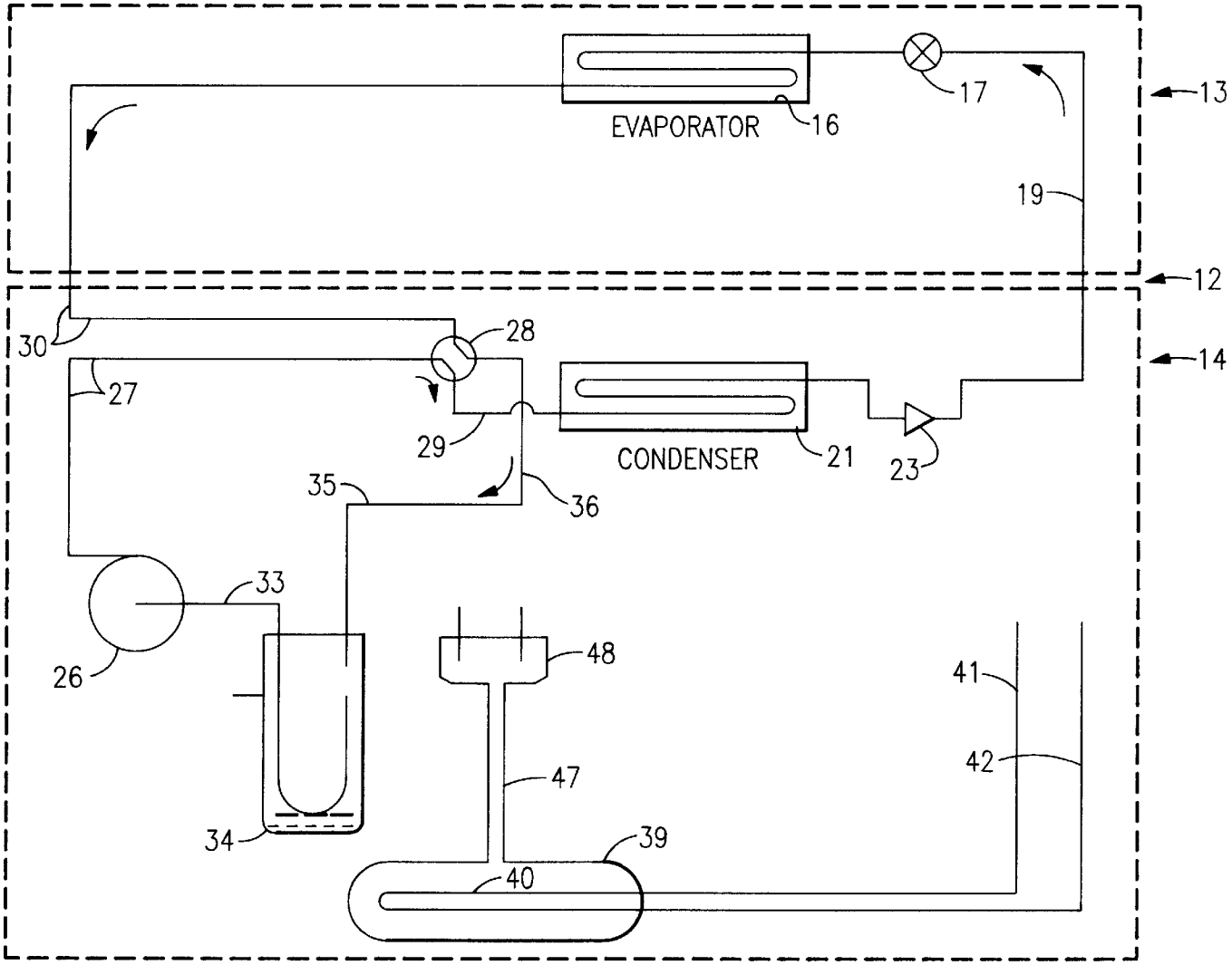
FIG. 7 is a schematic diagram of the system of FIG. 1, showing effective operation of only those parts which are used during normal cooling operation.

When derectification is complete, heating or cooling may be performed as shown in FIG. 3 or as shown in FIG. 7, respectively, with a 40% R134a blend, as shown in FIG. 8. FIG. 7 is the same as FIG. 3 except that the four-way valve 28 is positioned for cooling. The heater 40 and conduits 41, 42, the tank 39, column 47 and separator 48, and the conduits 56 and 57 are essentially not in the system.

Figure 10:
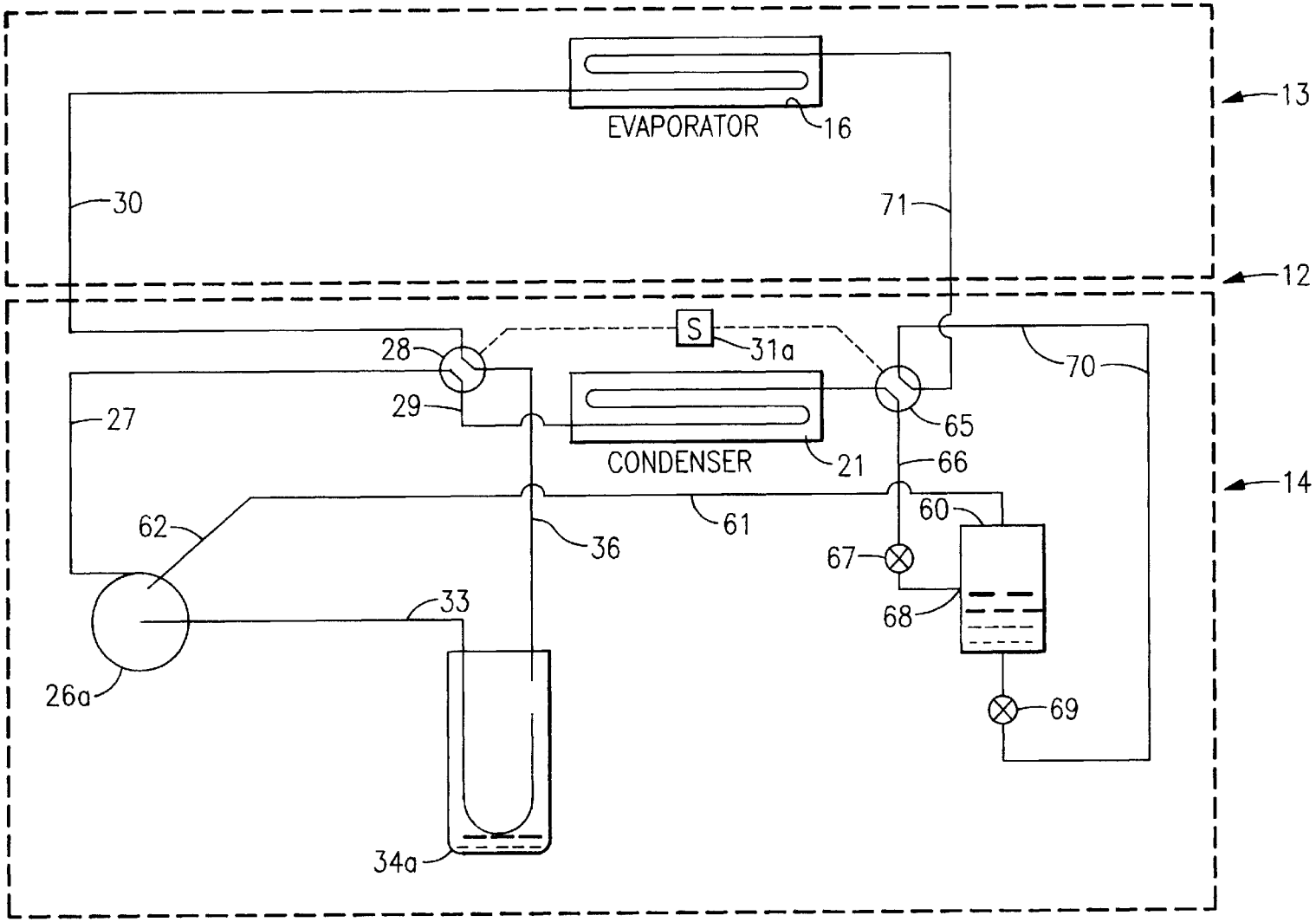
FIG. 10 is a schematic diagram of a bidirectional heat pump system in accordance with a second aspect of the present invention.

Referring now to FIG. 10, a second, intrastage compression aspect of the present invention utilizes a flash tank 60 to separate vapor from partially expanded condenser effluent and applies the vapor over a conduit 61 to an auxiliary inlet 62 of a modified compressor 26*a,* the inlet being at a selected intermediate pressure point of the compression stroke. In FIG. 10, the four-way valve 28 is positioned to cause the heat pump system to operate in the cooling mode. The coil 21 is serving as the condenser and its effluent flows through a second four-way valve 65 which is controlled in synchronism with the four-way valve 28 by any suitable electric or electronic means such as a solenoid 31*a.* The flow passes along a conduit 66 through an expansion valve 67 and to an inlet 68 of the flash tank 60. The liquid separates from the vapor and passes through a second expansion valve 69 and a conduit to the four-way valve 65, after which it is carried in a conduit 71 to the evaporator, which comprises coil 16 in the indoor section 13. The refrigerant then passes along the conduit 30, through the four-way valve 28, the conduit 36 and into the accumulator 34*a,* which is conventional in this embodiment.

Figure 9:
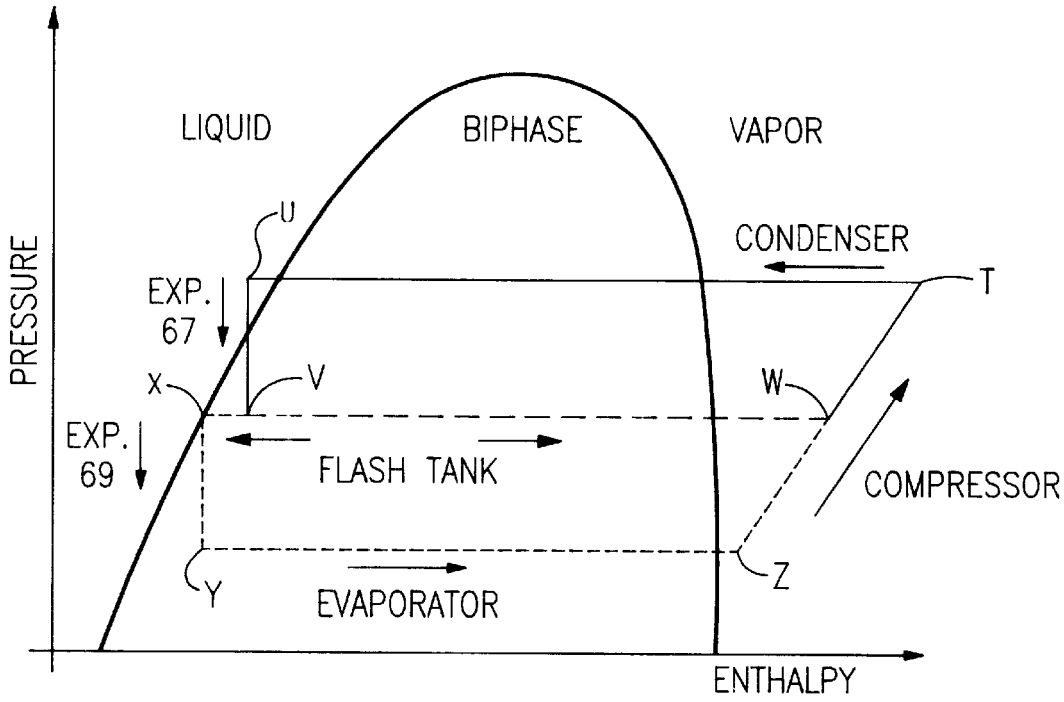
FIG. 9 is a thermodynamic diagram of the system cycle illustrating principles of the second aspect of the present invention (called intrastage compression).

The process is illustrated in FIG. 9 wherein refrigerant leaving the compressor 26*a* and entering the conduit 27 is at the highest pressure and enthalpy, at a point T in FIG. 9. As the refrigerant flows through the condenser, it loses heat, and therefore enthalpy, so that it emerges from the condenser with low enthalpy at high pressure, indicated at the point U. As the refrigerant passes through the first expansion valve 67, the pressure drops to a selected intermediate pressure in equilibrium at a temperature between the condenser temperature and the evaporator temperature, causing the liquid to become bi-phase as illustrated at point V. The selected intermediate pressure is determined in each case to be optimal as a system design tradeoff between maximizing efficiency and maximizing capacity, as required in each case, either by modeling or empirically. It may, in some cases, be a pressure substantially midway along the compression stroke of the compressor. The vapor passes along the conduit 61 and enters the inlet 62 of the compressor 26*a* at a pressure point in the compressor stroke equal to said selected intermediate pressure, as illustrated by the point W. This results in a higher system capacity. The remainder of the refrigerant leaves the flash tank as liquid as indicated by the point X, and it becomes bi-phase again as it passes through the expansion valve 69 reaching the lowest pressure at the point Y. Then the bi-phase refrigerant passes through the evaporator and the accumulator 34*a,* entering the compressor at the lowest pressure point of its stroke, as indicated at the point Z.

Figure 11:
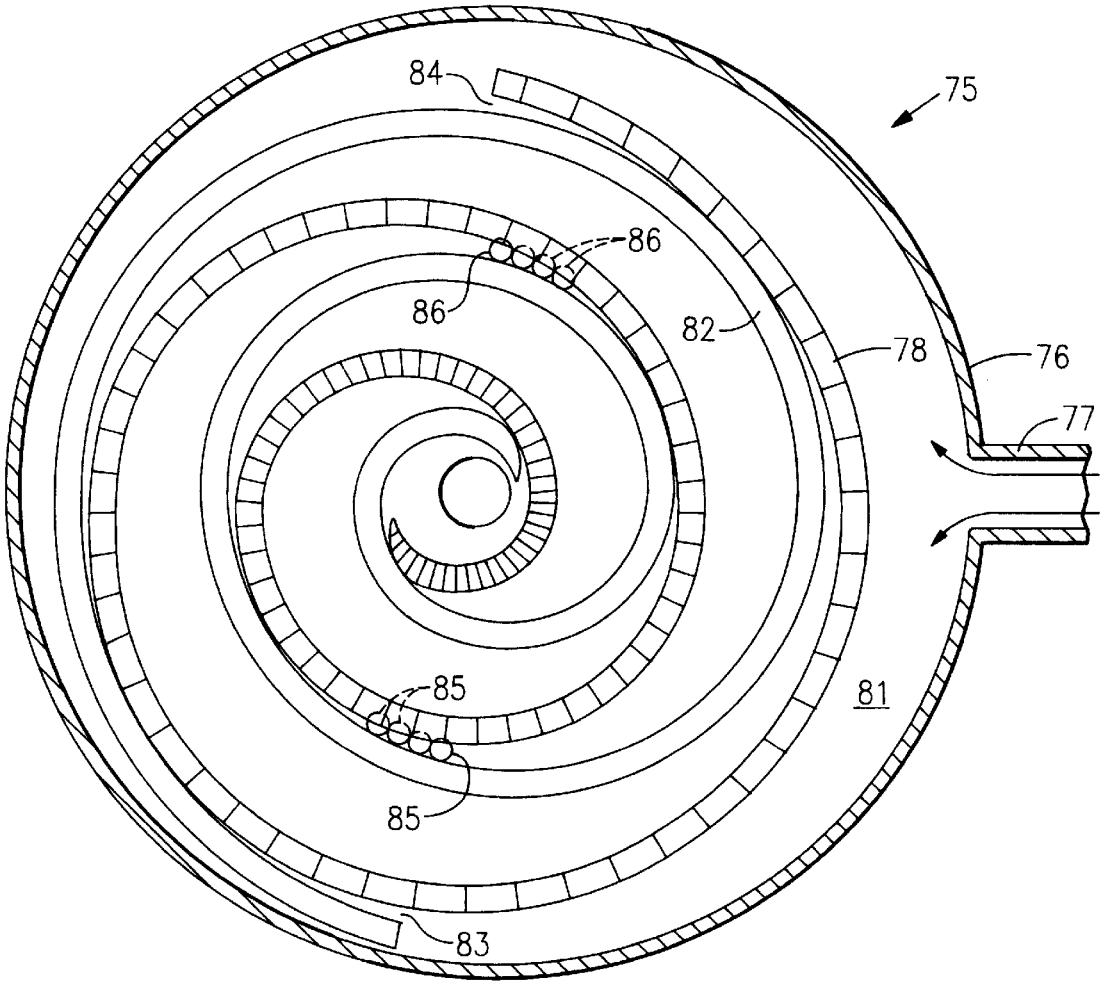
FIG. 11 is a partial, sectional view of a scroll compressor having vapor inlets in accordance with the present invention.

The compressor 26*a* may be a piston compressor or any other suitable compressor modified to have an inlet approximately mid-way along its compression stroke. However, a preferred mode for practicing the invention, illustrated in FIG. 11, utilizes a scroll compressor 75 which is shown sectioned through a casing 76 with an inlet 77 and through an orbiting scroll 78. The interior of the casing 76 forms a pressure chamber with a chamber bottom 81 and a chamber top (not shown). As the orbiting scroll 78 orbits around and within the stationary scroll 82, refrigerant vapor is entrained between the two scrolls at two points 83, 84, which comprise the inlets of two compression strokes, one occurring on each side of the stationary scroll 82. The compressor could have two moving scrolls. In accordance with the invention, each of these compression paths has a corresponding intrastage compression vapor inlet at a point which is approximately at the selected pressure point along the compression stroke. In FIG. 11, the inlets comprise four orifices 85, 86, which are convenient to form, as by drilling. However, the inlets could be other shapes so long as they are properly sized and positioned for maximum performance. In FIG. 11, the inlets are adjacent the respective edges of the stationary scroll 82, but they can be in any lateral position.

The invention, by taking a significant fraction of the mass flow of refrigerant into the compressor at a higher intermediate pressure point results in an increased mass flow of refrigerant, thereby increasing the cooling (or heating) effect for a given size of evaporator and condenser and a given amount of refrigerant in the system. A more powerful drive motor is required. However, even with an increased electrical power input requirement, the overall efficiency and EER are improved.

Figure 12:
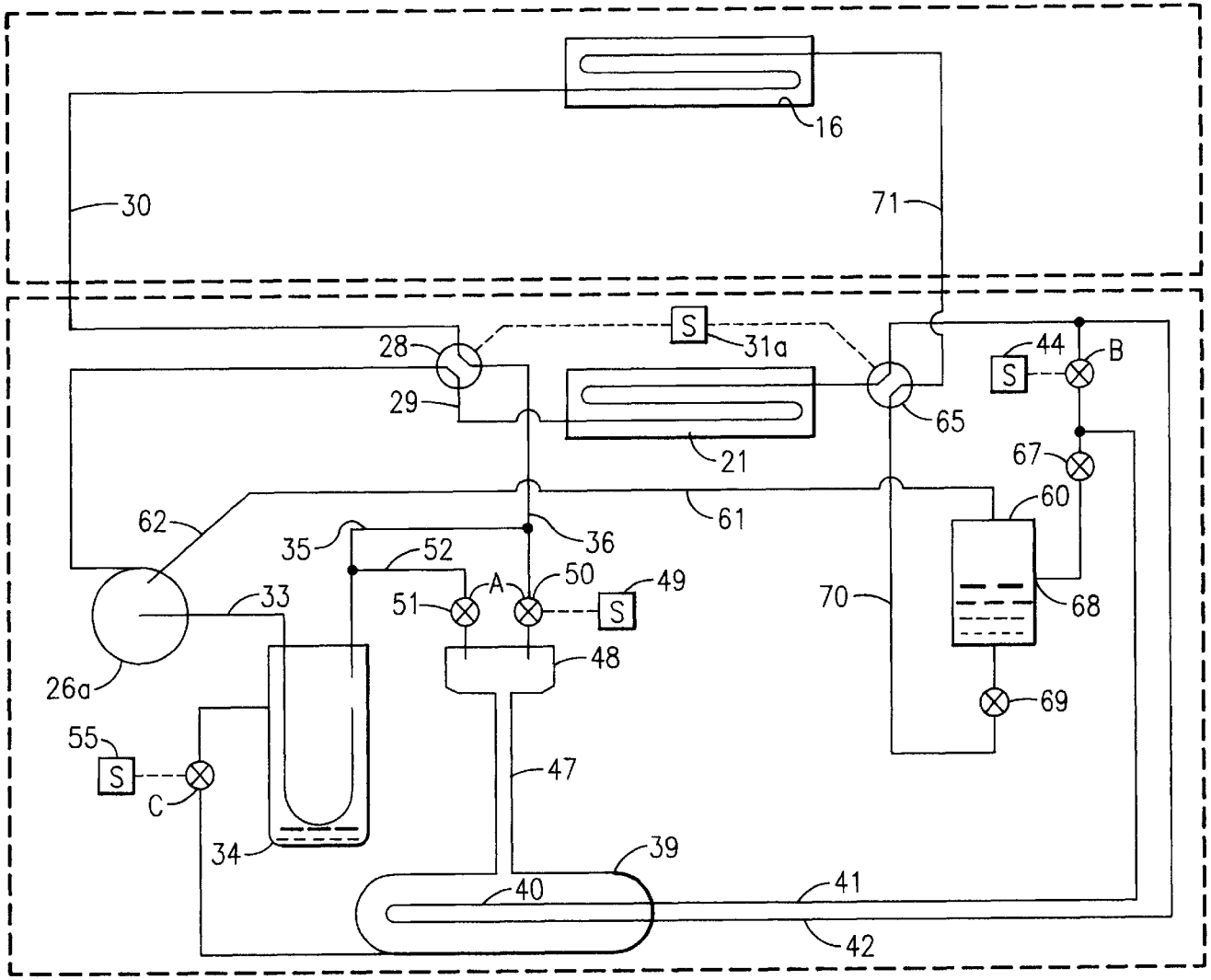
FIG. 12 is a schematic diagram of a bidirectional heat pump system incorporating the first and second aspects of the present invention.

Intrastage compression utilizing a flash tank, as illustrated in FIGS. 9–11, may be used for cooling in the configuration illustrated in FIG. 10 (or for heating by reversing the valves 28, 65), without any enhancements from adjusting the refrigerant composition as described hereinbefore with respect to FIGS. 1–8. On the other hand, both aspects of the present invention are preferably utilized together in any situation in which heating is to be performed as well as cooling. FIG. 12 illustrates a system having both aspects of the present invention incorporated therein. In the system of FIG. 12, all of the components operate in exactly the same fashion as described hereinbefore, neither of the features interfering with the other.

Figure 13:
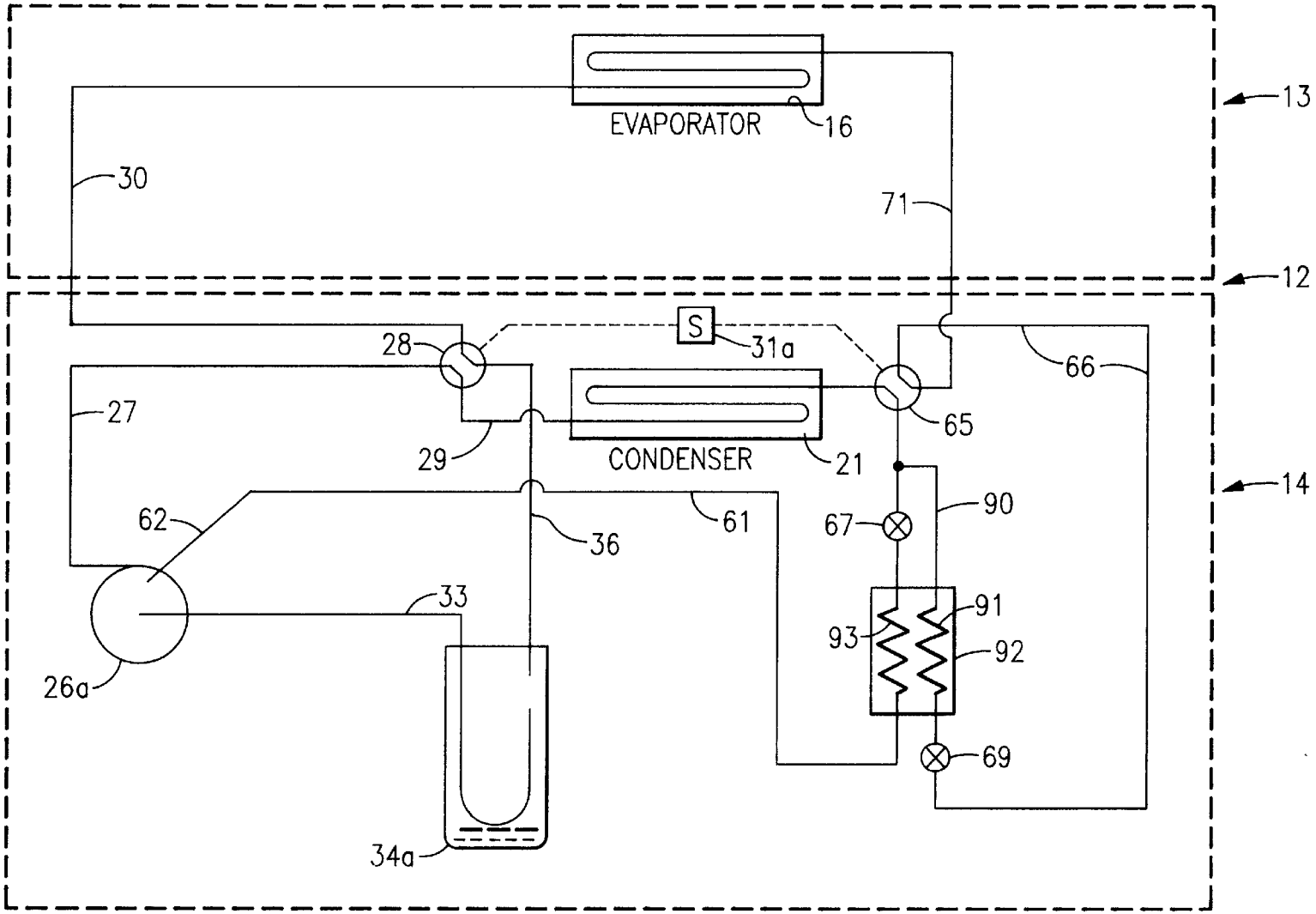
FIG. 13 is a schematic diagram of a bidirectional heat pump system in accordance with a second embodiment of the second aspect of the present invention.
Figure 14:
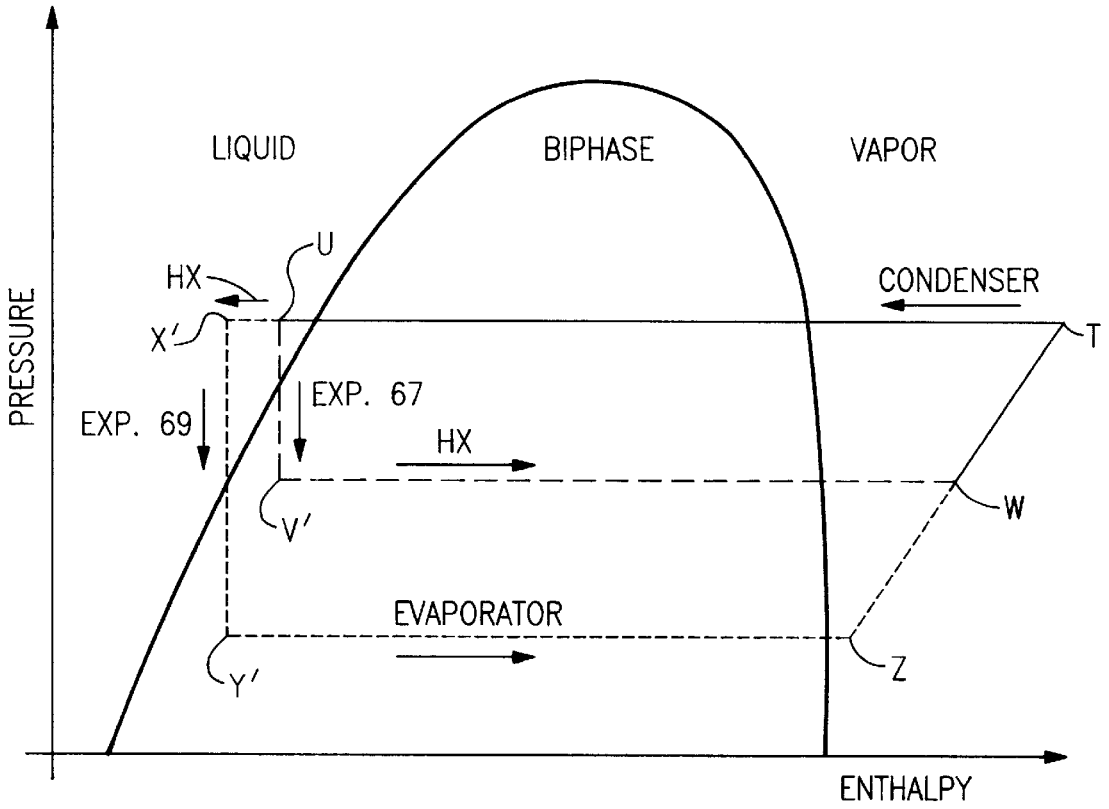
FIG. 14 is a phase diagram illustrating principles of the second embodiment of the second aspect of the present invention.

The intrastage compression aspect of the present invention can also be practiced utilizing a heat exchanger instead of a flash tank. In FIG. 13, the condenser effluent is directed by the four-way valve 65 to the expansion valve 67, as before. However, the flow is split and some of the flow passes through a conduit 90 to an exothermic (heat releasing) section 91 of a heat exchanger 92, the endothermic (heat providing) section 93 of which receives the expanded condenser effluent from the expansion valve 67. Referring to the phase diagram of FIG. 14, the effluent of the compressor 26*a* in the conduits 27 and 29 has pressure and enthalpy at the point T higher than at any other point in the system. As the refrigerant passes through the condenser, it gives off heat and thereby loses enthalpy leaving the condenser with pressure and enthalpy indicated at point U. Some of the flow passes through the expansion valve 67 and undergoes a reduction in pressure reaching the point V'. The liquid in the conduit 90 passes through the heat exchanger giving off heat into the vapor which enters the heat exchanger from the valve 67. This increases the enthalpy of the vapor so that it reaches the point W in FIG. 14, the condition in which it is passed along the conduit 61 for entry into the compressor 26*a* at the inlet 62. By giving off heat, the liquid in the portion 91 of the heat exchanger loses more enthalpy reaching the point X'. Then it passes through the expansion valve 69, expanding to become bi-phase at the point Y'. The refrigerant then passes through the evaporator, picking up heat and vaporizing to reach the point Z. This vapor then enters the compressor at its normal input, through the conduits 30, 36 and 33.

The heat exchanger embodiment of FIG. 13 may be used for heating by switching the valves 28, 65 and may be combined with the other aspects of the invention, in a manner which is obvious in view of FIGS. 10 and 12.

The invention has been described in terms of operation with R407C as the refrigerant. However, the first aspect of the invention applies as well to zeotropic refrigerants having two or more components. The invention has been described in terms of indoor and outdoor sections, but of course the primary coils may have other, similar relationships. The invention has been described utilizing expansion valves, but other expansion devices such as capillary tubes and the like may be utilized wherever appropriate, within the scope of the invention. The invention may be used with a variable speed compressor to improve capacity and/or efficiency, as between heating and cooling operations. The embodiments of FIGS. 10, 12 and 13 could use multiple expansion devices and bypass valves in a conventional fashion, ahead of the four-way valve shown, so as to cause the expansion of refrigerant immediately before entering a coil. All of the foregoing is irrelevant to the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A heat pump system comprising:

an indoor primary coil;

an outdoor primary coil;

a compressor;

a suction accumulator feeding the input of said compressor;

means for alternatively directing the effluent of said compressor to said outdoor coil and for directing effluent of said indoor coil to said suction accumulator so that said outdoor coil serves as a condenser, said indoor coil serves as an evaporator and said heat Pump system operates in a cooling mode, or for directing the effluent of said compressor to said indoor coil and the effluent of said outdoor coil to said suction accumulator so that said indoor coil serves as a condenser, said outdoor coil serves as an evaporator, and said heat pump system operates in a heating mode; and means for selectively expanding the refrigerant flowing from the one of said coils serving as condenser to the one of said coils serving as evaporator;

characterized by the improvement comprising:

said expanding means comprising a pair of expansion devices, the inlet of a first one of said pair connected to the outlet of the one of said primary coils serving as a condenser, the outlet of the other of said pair connected to the inlet of the one of said primary coils serving as an evaporator;

said compressor having an auxiliary inlet at a selected intermediate pressure point of its compression stroke;

and further comprising:

means disposed between the outlet of said first one of said pair and the inlet of said second one of said pair for separating vapor at said selected intermediate pressure in equilibrium with a temperature which is between the temperature of the effluent of the one of said primary coils serving as said evaporator and a temperature of the effluent of the one of said primary coils acting as the condenser, and for applying said separated vapor to said auxiliary inlet, said separation means comprising a heat exchanger, the inlet of one coil thereof being connected to the outlet of said first pair of said expansion devices, the outlet of said first coil being connected to said auxiliary input of said compressor, the inlet of another coil of said heat exchanger being connected between the inlet of said first one of said expansion devices and the outlet of the one of said primary coils serving as a condenser to divert some of the flow therefrom, and the outlet of said another coil being connected to the inlet of said second one of said expansion devices.

2. A method of improving the capacity and efficiency of a heat pump system, comprising:

providing a compressor in said heat pump system having an auxiliary inlet at a selected intermediate pressure position of the compressor's compression stroke;

expanding a portion of the effluent of the condenser to said selected intermediate pressure;

heating the vapor of the expanded effluent portion by heat exchange with the liquid of the remaining portion of the effluent and applying said vapor to said auxiliary inlet; and expanding the liquid of said remaining effluent and applying it to the evaporator of said system.

3. A method of improving the capacity and efficiency of a heat pump system and for extending the heating capability thereof in low ambient temperatures, comprising:

providing a compressor in said heat pump system having an auxiliary inlet at a selected intermediate pressure position of the compressor's compression stroke;

providing a storage tank;

providing a rectification column in liquid communication with said tank and in vapor communication with a suction accumulator of said system;

charging said system and said storage tank with a multi-component refrigerant blend having a low pressure component which is zeotropic with respect to the remainder of said blend;

rectifying the refrigerant in said tank to thereby remove a substantial mass percent of said low pressure component from the blend operating in said system and holding the removed low pressure component in said tank;

expanding a portion of the effluent of the condenser to said selected intermediate pressure;

heating the vapor of the expanded effluent portion by heat exchange with the liquid of the remaining portion of the effluent and applying said vapor to said auxiliary inlet; and expanding the liquid of said remaining portion of the effluent and applying it to the evaporator of said system.

* * * * *